United States Patent [19]

Stoll

[11] 4,352,320

[45] Oct. 5, 1982

[54] SINGLE-ACTING OPERATING CYLINDER

[76] Inventor: Kurt Stoll, Lenzhalde 72, D-7300 Esslingen, Fed. Rep. of Germany

[21] Appl. No.: 162,999

[22] Filed: Jun. 25, 1980

[30] Foreign Application Priority Data

Jun. 29, 1979 [DE] Fed. Rep. of Germany ..... 2926258

[51] Int. Cl.[3] ..... F15B 15/24; F01B 31/00

[52] U.S. Cl. ..... 92/13; 92/130 D; 92/133; 267/175

[58] Field of Search ..... 92/133, 130 D, 130 R, 92/13.4, 13.41, 13; 267/175, 177

[56] References Cited

U.S. PATENT DOCUMENTS

| | | | |
|---|---|---|---|
| 1,708,171 | 4/1929 | Halvorsen | 92/133 |
| 2,270,767 | 1/1942 | Platz | 92/130 D |
| 2,355,520 | 8/1944 | Fischer et al. | 92/130 D |
| 2,735,669 | 2/1956 | Seiler | 267/175 |
| 2,891,784 | 6/1959 | Taylor | 267/175 |
| 3,495,508 | 2/1970 | Allen | 92/132 |

FOREIGN PATENT DOCUMENTS

| | | | |
|---|---|---|---|
| 1247883 | 8/1967 | Fed. Rep. of Germany | 92/133 |
| 2718639 | 11/1978 | Fed. Rep. of Germany . | |
| 2201409 | 4/1974 | France . | |

*Primary Examiner*—Paul E. Maslousky

*Attorney, Agent, or Firm*—Blanchard, Flynn, Thiel, Boutell & Tanis

[57] ABSTRACT

A single-acting operating cylinder assembly includes a cylinder and piston of rectangular cross section and a spring arrangement for initially forcing the piston into one operating position. The piston has an axial recess with transverse end walls. A stop block is located within the recess and securable to the cylinder for movement of the piston with respect to the stop block. The spring arrangement is formed by a plurality of side-by-side lying helical compression springs supported between the stop block and the recess end wall opposite the stop block. In one embodiment, the stop block is positioned with respect to the cylinder by an eccentric disk adjustable for adjusting both end positions of the piston in the same direction while retaining a constant piston stroke. In a second embodiment, fixed pins and an adjustable disk connect a modified stop block with the cylinder for adjustability of the length of the piston stroke with one of the piston end positions held constant.

6 Claims, 4 Drawing Figures

SINGLE-ACTING OPERATING CYLINDER

FIELD OF THE INVENTION

The invention relates to a single-acting operating cylinder of the type having a rectangular cross section and a spring arrangement for initially forcing the piston into one operating end position.

BACKGROUND OF THE INVENTION

A prior operating cylinder of the aforementioned type is described in German OS No. 27 18 639. However, its piston does not have any exactly presettable operating positions.

An object of the present invention is to provide an improved operating cylinder of the aforementioned type, improved so that the piston is moved, through pressure admission or under the spring force, into exactly preselectable operating end positions, and wherein the inventive operating cylinder is compact, as needed for a plurality of uses, for example as a servomotor in industrial sewing machines.

In the inventive operating cylinder, a spring arrangement and a stop mechanism which control the end positions of the piston are stored within the volume of the piston, and thus do not need any additional space. A further advantage of the inventive operating cylinder is that one can build the spring arrangement of commercial helical coil compression springs, while the above-mentioned known operating cylinder has a special spring with a rectangular coil cross section.

BRIEF DESCRIPTION OF THE DRAWINGS

The invention will be discussed in greater detail hereinafter in connection with two exemplary embodiments and reference to the enclosed drawings, in which.

DETAILED DESCRIPTION

Figure 1:
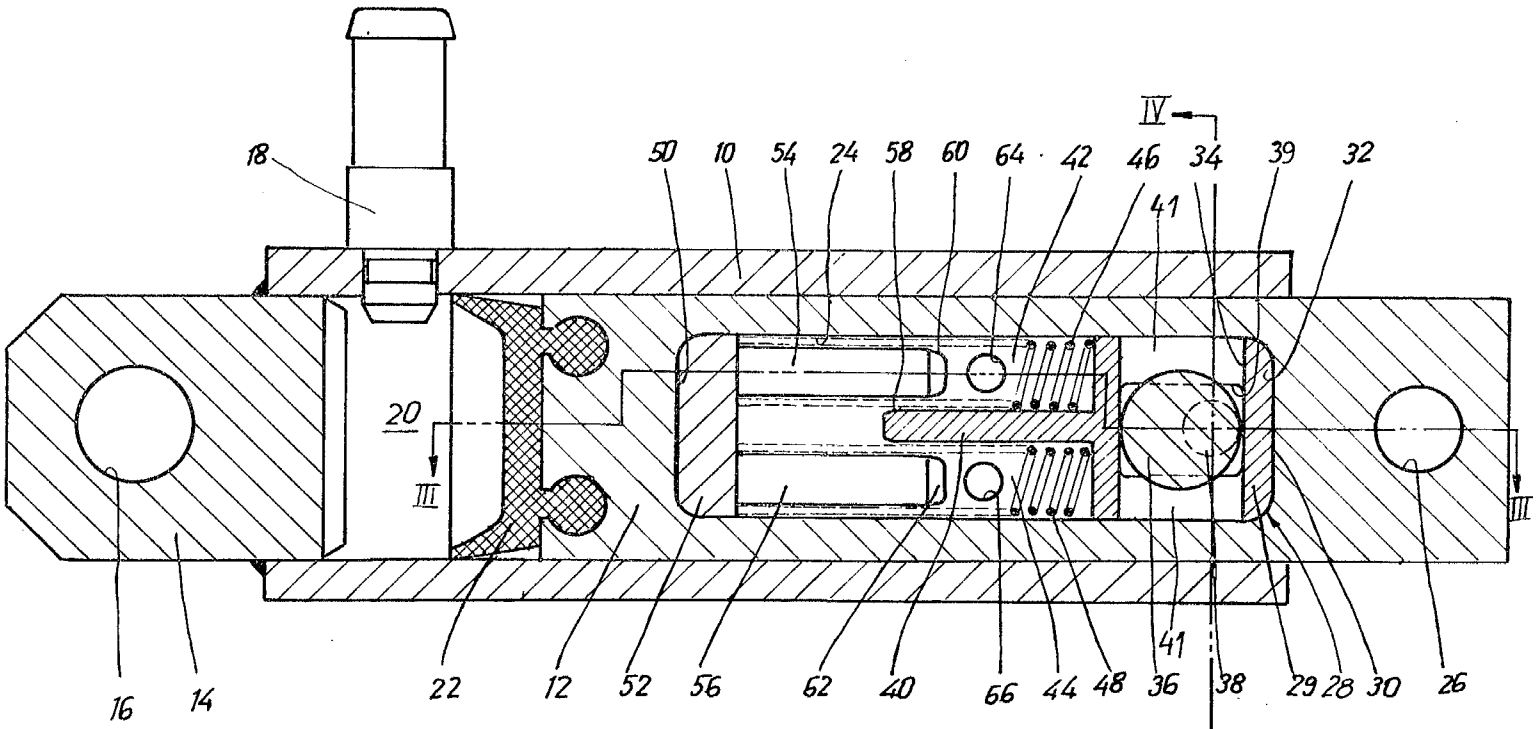
FIG. 1 is an axial cross-sectional view of a working cylinder which has small dimensions, is compact and single-acting, with a stop mechanism which gives the piston end positions, in which at a constant piston stroke the piston end positions can be adjusted in the same direction.

The single-acting operating cylinder illustrated in the drawings includes a cylinder 10 of rectangular cross section and a piston 12 which is movable in said cylinder and has a rectangular cross section. The narrow sides of the cross section of cylinder and piston, which extend perpendicular to the drawing plane in FIG. 1, are considerably smaller than the wide sides thereof, which are shown in FIG. 1. The cylinder 10 has a rectangular cross-section and is a one-piece made tube manufactured by drawing or deep-drawing. The leftward end of the cylinder 10 is closed off tightly by a welded-in front part 14, which has a fastening opening 16. A fitting 18 for connection of a compressed-air hose (not shown) is connected with the leftward end of the operating chamber 20, which is defined by the cylinder 10 and the piston 12.

The piston 12 carries on its left end a piston packing 22, which is constructed similar to a lip seal. The piston 12 also contains an axial recess 24 in the form of an extended rectangle and a fastening opening 26 for a machine part to be driven.

A stop block 28, which is constructed as a slide member, is arranged on the right side in the recess 24. The front (rightward) surface 30 of the front part 29 of the stop block 28 is complementary to the rightward end wall 32 of the recess 24. The stop block 28 has a transverse sliding-guide groove 34, in which an eccentric disk 36 runs substantially free of play. The disk 36 is supported by stub shafts 38 in the wide sidewalls of the cylinder 10, which sidewalls are opposite one another. The stub shafts can be locked by clamping screws or the like in their desired position of angular adjustment.

The stop block 28 includes a partition wall 40 which is formed to extend toward the left. This partition wall 40 together with the recess 24 provides two spring chambers 42, 44, in which are seated, with play, first ends of helical coil compression springs 46, 48. The front part 29 and partition wall 40 of the stop block 28 may be rigidly interconnected by an axially extending web 41 beside the disk 36 in the drawing. Slot 39 permits leftward-rightward movement of the stop block 28 without interference by the shaft 38 during adjustive rotation of the disk 36.

A spring seat member 52 rests solidly on the leftward end wall 50 of the recess 24. The spring seat member 52 carries two centering pins 54 and 56 which extend to the right and which engage, with clearance, the left side ends of the helical coil compression springs 46 and 48.

The inventive operating cylinder permits long piston strokes, while protecting the helical coil compression springs 46, 48 against lateral buckling, due to interposition of the partition wall 40 between the springs and due to the centering mandrels 54, 56.

In order to permit an unhindered passing of the individual coils of the helical coil compression springs 46 and 48 during a shifting of the piston 12 due to admission of pressure to the operating chamber 20, the partition wall 40 is provided with an inclined converging end section 58. The centering pins 54 and 56 also have for the same reason inclined converging end sections 60 and 62, the front ends of which are additionally rounded.

The spring chambers 42 and 44 are connected through ventilation openings 64, 66 which communicate through the sidewalls of the cylinder 10 to the atmosphere.

The above-described operating cylinder has an initial operating position shown in FIG. 1 in which the helical coil compression springs 46 and 48 urge the piston 12 to the leftward limit of its path, which limit is established by contact of the piston recess end wall 32 against the rightward facing front wall 30 of the stop block 28. The second operating position of the piston 12 (which is to the right of its position in FIG. 1) is obtained by admission of pressure fluid to the operating chamber 20 to overcome the force of the helical coil compression springs 46 and 48, and thus extend the piston 12 further out of the operating cylinder 10. The rightward limit of travel of the piston 12 is established by contact of the partition wall 40 against the spring seat member 52. The centering pins 54 and 56 are slightly shorter axially than the partition wall 40. For that reason, the centering pins need not be aligned exactly with the axis of the piston nor be exactly of equal length, and yet still will not apply a canting torque to the piston 12 when the latter moves into its second (rightward) end position. The fact that the number of partition walls (such as 40) is one less than the number of centering mandrels (such as 54,56) or, with only a single partition wall provided that such partition wall engages the piston along the axis of the piston, further avoids generation of a canting torque.

If one rotates the eccentric disk 36 from its position shown in FIG. 1, then both end positions of the piston 12 are moved to the right in FIG. 1, but the stroke of the piston 12 remains unchanged because it depends only on the axial length of the recess 24 and the entire axial dimension of the stop block 28 (including the axial dimension of the partition wall 40).

Figure 2:
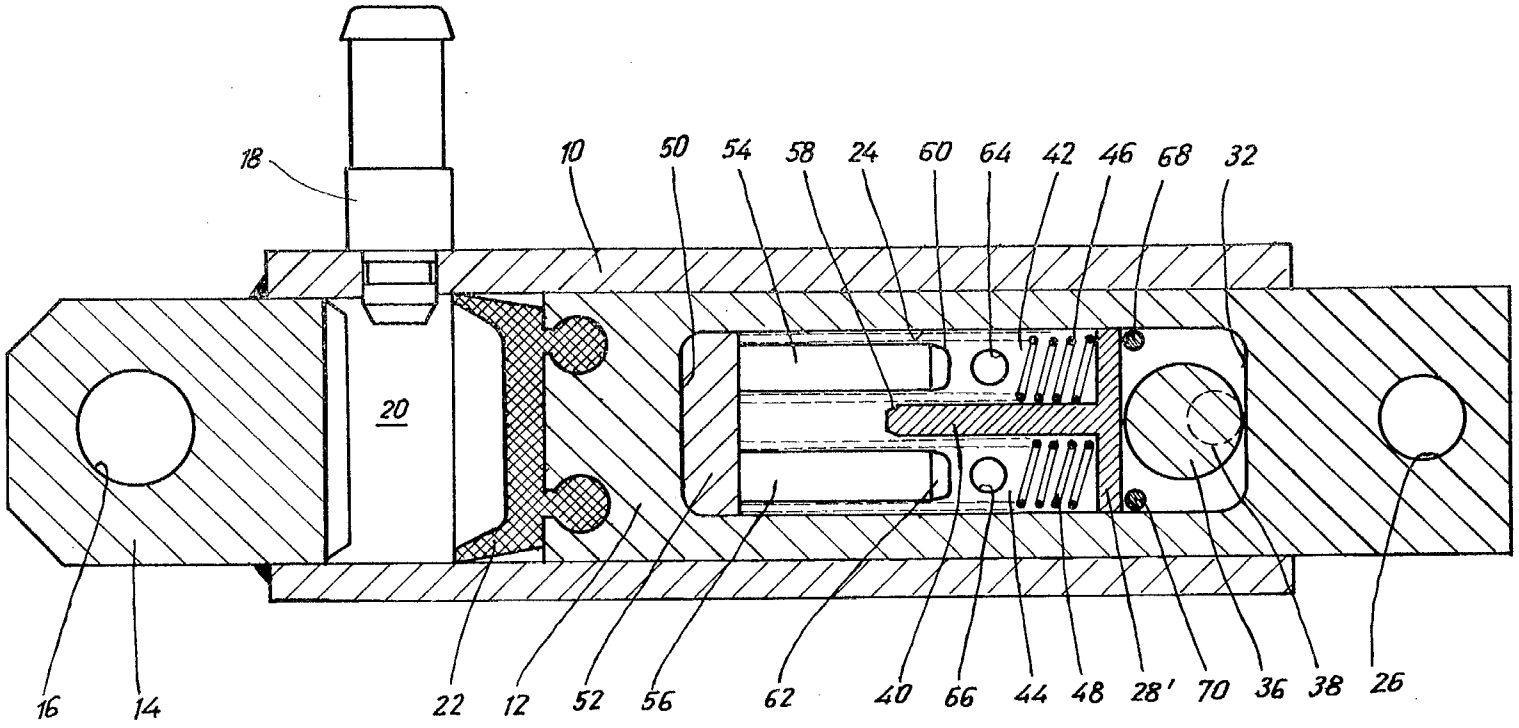
FIG. 2 is an axial cross-sectional view of an operating cylinder similar to that illustrated in FIG. 1, wherein, however, one of the end positions cannot be adjusted but the piston stroke can be adjusted.
Figure 3:
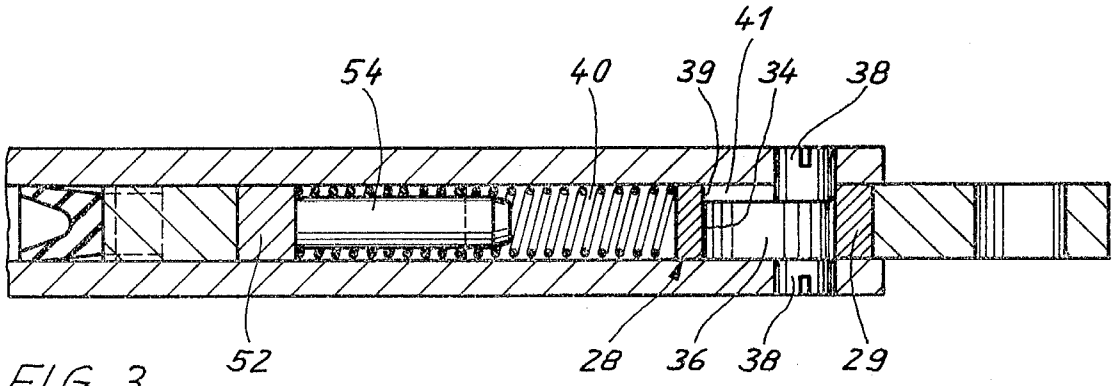
FIG. 3 is a sectional view taken substantially on the line III—III of FIG. 1.
Figure 4:
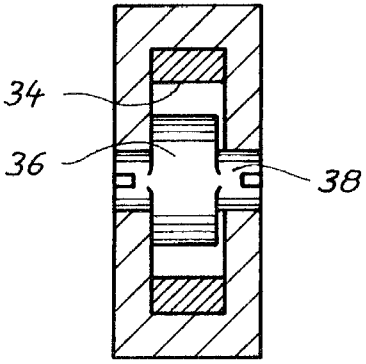
FIG. 4 is a sectional view taken substantially on the line IV—IV of FIG. 1.

The operating cylinder illustrated in FIG. 2 is substantially similar to the one illustrated in FIG. 1; only the stop mechanism which gives the end positions is slightly modified, in order to achieve adjustability of the piston stroke. Parts of the operating cylinder, which have already been described with reference to FIG. 1, are again provided with the same reference numerals and do not need to be discussed again here.

The modified stop block 28' of FIG. 2 retains only the part of the FIG. 1 stop block 28 to the left of the sliding-guide groove 34 in FIG. 1. The stop block 28' (FIG. 2) is axially backed directly and in a nonadjustable axial position by pins 68 and 70 fixedly mounted on the cylinder 10. This also fixedly locates the rightwardmost operating position of the piston 12.

An eccentric disk 36 is arranged in the part of the recess 24 remaining to the right of the stop block 28'. As in the FIG. 1 embodiment, the FIG. 2 disk 36 is supported through stub shafts 38 in the cylinder 10 and can be locked by clamping screws or the like in any desired angular position of adjustment. The eccentric disk 36 directly engages, in the FIG. 2 embodiment, the rightward end wall 32 of the recess 24, and thus independently defines the leftwardmost operating position of the piston 12, toward which position the piston is urged by the springs 46,48. In FIG. 2 the eccentric disk 36 is positioned to locate the leftwardmost operating position of the piston 12 farthest to the left. By rotating the eccentric disk 36, such leftwardmost operating position of the piston 2 can be moved to the right. Since the rightwardmost operating position of the piston is nonchangeable as above stated, such rotation of the disk 36 in FIG. 2 results in a suitable reduction of the stroke of piston 12.

It will be recognized that the two above-described single-acting operating cylinders have exactly presettable operating positions and at the same time have a very compact structure. By slight modifications and by using substantially the same parts, the present invention thus can achieve either an adjustability of the location of both piston end positions in the same direction while retaining a constant piston stroke, or an adjustability of the length of the piston stroke with one of the piston end positions held constant.

The connection of the eccentric disk and shaft 9 advantageously provides for simple assembly of the servomotor, since eccentric disk and shaft in the one position shown are introducable together and without force into the recess of the piston which is already under the initial force of the springs.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A single-acting operating cylinder assembly comprising a cylinder having an operating chamber and a piston of rectangular cross section, wherein the piston contains an axial recess which has a first end wall remote from the operating chamber of the cylinder, a spring arrangement in said axial recess for urging the piston into a retracted working position, said spring arrangement being supported on the piston and on a stop mechanism which is connected to the cylinder, and further comprising the improvement wherein:

(a) the axial recess in the piston also has a second end wall adjacent the operating chamber of the cylinder;

(b) the stop mechanism extends through the axial recess transversely of the longitudinal axis of the cylinder and includes end stops for limiting both the extension and retraction directions of movement of the piston, the stop mechanism including a stop block which carries the said end stop for limiting the extension movement of the piston;

(c) the spring arrangement comprises a plurality of side-by-side coil compression springs which are clamped between the stop block and the second end wall of the axial recess; and (d) said end stop for limiting the extension movement of the piston is formed by at least one partition wall, which partition wall lies between a pair of the compression springs and defines separate spring chambers receiving said springs.

2. An assembly according to claim 1, wherein the coil compression springs engage a spring-seat member on the second end wall of the recess, which spring seat member has a front surface which is complementary to said second end wall of said recess and has centering mandrels which extend toward the first end wall and engage with clearance the compression springs, said centering mandrels being slightly shorter than the partition wall.

3. An assembly according to claim 2, wherein the partition walls and the centering mandrels have end sections, at least one of said end sections being of generally converging shape.

4. An assembly according to one of the claims 1 to 3, wherein the stop block is located by an eccentric disk adjustably carried on the cylinder, which eccentric disk runs in a transverse sliding-guide groove in the stop block.

5. An assembly according to one of the claims 1 to 3, wherein the stop block also includes said end stop for limiting the retraction movement of the piston, which latter end stop cooperates with the first end wall of the recess.

6. An assembly according to one of claims 1 to 3, wherein the stop block is supported in a fixed axial position on the cylinder and said stop mechanism includes an adjustable eccentric disk which defines said end stop for limiting the retracting movement, and cooperates with the first end wall of the recess.

* * * * *